US007849635B2

(12) United States Patent
Langner

(10) Patent No.: US 7,849,635 B2
(45) Date of Patent: Dec. 14, 2010

(54) BUILDING ENCASEMENT ELEMENT

(75) Inventor: Thomas Langner, Schwanewede (DE)

(73) Assignee: Vector Foiltec, Bremen (DE)

( * ) Notice: Subject to any disclaimer, the term of this patent is extended or adjusted under 35 U.S.C. 154(b) by 0 days.

(21) Appl. No.: 12/358,620

(22) Filed: Jan. 23, 2009

(65) Prior Publication Data

US 2010/0186306 A1 Jul. 29, 2010

(51) Int. Cl.
*E04G 11/04* (2006.01)
*E04H 15/20* (2006.01)

(52) U.S. Cl. ..... 52/2.22; 52/2.11; 52/2.14; 52/2.19; 52/2.23; 52/2.24; 52/2.25

(58) Field of Classification Search ..... 52/2.22, 52/2.11, 2.14, 2.19, 2.23, 2.24, 2.25
See application file for complete search history.

(56) References Cited

U.S. PATENT DOCUMENTS

| | | | | |
|---|---|---|---|---|
| 3,660,951 | A | 5/1972 | Cadwell | 52/2.18 |
| 4,160,523 | A | 7/1979 | Stevens | 126/625 |
| 6,108,980 | A | 8/2000 | Braun | 52/2.16 |
| 6,463,699 | B1 | 10/2002 | Bailey et al. | 52/2.11 |
| 6,860,069 | B2 | 3/2005 | Morris | 52/2.22 |
| 2004/0031207 | A1 | 2/2004 | Fleming | 52/2.11 |
| 2004/0074151 | A1 | 4/2004 | Morris | 52/2.22 |
| 2007/0094937 | A1 | 5/2007 | Pedretti | 52/2.11 |

*Primary Examiner*—Richard E Chilcot, Jr.
*Assistant Examiner*—Mark R Wendell
(74) *Attorney, Agent, or Firm*—Hollingsworth & Funk, LLC

(57) ABSTRACT

Described is a building encasement element (100) with a foil cushion that comprises an outer foil layer (101) forming the outside of a building envelope and an inner foil layer (102) forming the outside of a building envelope, wherein these foil layers form, between themselves, at least one essentially fluid-tight, enclosed hollow space in which a fluid medium, in particular, air, is contained, and with a reinforcement element (107). The special feature of the invention consists in that the reinforcement element (107) divides the essentially fluid-tight, enclosed hollow space into a first, essentially fluid-tight, enclosed chamber (108) between the inner foil layer (102) and the reinforcement element (107) and into a second, essentially fluid-tight, enclosed chamber (109) between the outer foil layer (101) and the reinforcement element (107), the fluid medium in the first chamber (108) is pressurized with a first pressure and the fluid medium in the second chamber (109) is pressurized with a second pressure below that of the first, and the magnitudes of the first and second pressures and/or the ratio of the first and second pressures is formed so that the reinforcement element (107) reduces the stress on the foil layer (101) especially for outwards directed drag effects, in that a portion of the load on the outer foil layer (101) is transmitted via the pressurized fluid medium onto the reinforcement element (107).

13 Claims, 1 Drawing Sheet

BUILDING ENCASEMENT ELEMENT

FIELD OF THE INVENTION

The building relates to a building encasement element with a foil cushion that comprises an outer foil layer forming the outside of a building envelope and an inner foil layer forming the inside of a building envelope, wherein these foil layers form, between themselves, at least one essentially fluid-tight, enclosed hollow space in which a fluid medium, in particular, air, is contained, and with a reinforcement element.

BACKGROUND

Building encasement elements are used, in a known way, in foil roof systems and foil facade systems. These foil roof and foil facade systems are advantageously used in erecting commercial buildings, such as sports stadiums, convention centers, or shopping centers. These buildings that usually have very large roof and facade surface areas utilize, among other things, the advantages associated with foil roof or foil facade systems, such as lightness and transparency or flexibility of the coloring.

According to standards, foil cushions are made from two outer foil layers that are connected to each other in an essentially fluid-tight way and that are commonly welded to each other along their edges, in order to form an essentially fluid-tight, enclosed hollow space between the layers. During the production of the foil cushion, a fluid medium, in particular, a gas, such as, e.g., air, is introduced into this hollow space, by means of which the foil layers are tensioned accordingly and the foil cushion obtains its intended shape. In the installed state, the foil cushions are also usually equipped with a device for supplying a fluid medium. This device can regulate, for example, the air pressure in the foil cushion.

The fluid medium introduced into the foil cushion, however, is used not only for shaping the cushion, but also for thermal insulation, which forms another advantage of the foil system.

In order to withstand intense stresses on a building envelope, such as, for example, wind loads, and here, in particular, wind-drag loads, existing solutions propose to double the outer foil layer. Through this doubling, a foil cushion can absorb higher stresses, in particular, wind-drag loads. A disadvantage here, however, is primarily the high material use that can lead to high costs for large surface area building envelopes. Although the two outer foil layers are connected to each other in an essentially fluid-tight way, it definitely often happens that condensate forms between these two foil layers, which is undesirable just for visual reasons.

Therefore, one problem of the present invention is to improve a building encasement element of the type named above such that at least one of the mentioned disadvantages is lessened.

SUMMARY

This problem is solved by a building encasement element with a foil cushion that comprises an outer foil layer forming the outside of a building envelope and an inner foil layer forming the inside of a building envelope, wherein these foil layers form, between themselves, at least one essentially fluid-tight, enclosed hollow space in which a fluid medium, in particular, air, is contained, and with a reinforcement element characterized in that the reinforcement element divides the essentially fluid-tight, enclosed hollow space into a first, essentially fluid-tight, enclosed chamber between the inner foil layer and the reinforcement element and into a second essentially fluid-tight, enclosed chamber between the outer foil layer and the reinforcement element, and the fluid medium in the first chamber is pressurized with a first pressure and the fluid medium in the second chamber is pressurized with a second pressure below that of the first, and the magnitudes of the first and second pressures and/or the ratio of the first and second pressures is formed so that the reinforcement element reduces the stress on the outer foil layer, especially for outwards directed drag effects, in that a part of the stress on the outer foil layer is transmitted via the pressurized fluid medium onto the reinforcement element.

The reinforcement element obtains its load-bearing function through the coupling with the outer foil layer via the pressurized fluid medium. Therefore, for improving the load capacity of the foil cushion according to the invention by the reinforcement element, the pressure formation in the chambers is decisive.

For this purpose, the magnitudes of the first and second pressures and/or the ratio of the first and second pressures is formed so that the reinforcement element reduces the stress on the outer foil layer, especially for outwards directed drag effects, in that a part of the stress on the outer foil layer is transmitted via the pressurized fluid medium onto the reinforcement element.

In this way, doubling of the outer foil layer like in the state of the art is no longer required, because the reinforcement element in the interior supports the load bearing.

The building encasement element according to the invention can be improved such that the reinforcement element is composed, at least in some sections, from a material permitting dimensional changes, in particular, an elastic material. The load transmission from the outer foil layer via the fluid medium onto the reinforcement element is supported in that the reinforcement element is not dimensionally stable, but instead can adapt its shape and for this purpose is made from an elastic material. The same can also apply to the outer foil layer that can then be made, at least in some sections, from a material permitting dimensional changes, in particular, an elastic material. The load transmission is further supported if the outer foil layer is also not dimensionally stable, but instead can adapt its shape and for this purpose is made from an elastic material.

In one preferred improvement of the invention, the reinforcement element is formed as an essentially planar element, i.e., the reinforcement element has, in its height, a significantly smaller extent than in its length and width. Planar elements are, for example, mats, foils, fabric layers, or lattices.

Advantageously, the reinforcement element is curved, that is, in the same direction as the outer foil layer that is conventionally curved outward. In a preferred improvement of this configuration, the curves of the reinforcement element and the outer foil layer should be similar to each other. This is advantageous for an especially effective load transmission.

Another improvement of the invention provides that the reinforcement element is formed as another foil layer. This has the advantage that for simplifying the production, for example, the same material can be used for the two outer foil layers and the reinforcement element. For this purpose, for example, the inner foil layer can also be made from the same elastic material as the outer foil layer and/or the reinforcement element. The partition of the foil cushion into two chambers by the reinforcement element also creates a two-layer thermal insulation and thus an improvement of the insulation effect of the foil cushion as a whole, in that, in particular, the second chamber contributes to the thermal insulation.

In another improvement of the invention, the second chamber has a smaller volume than the first chamber.

The building encasement element according to the invention can be further improved in that the stress in the reinforcement element equals at least 80%, but, for example, also greater than 100% of the stress in the outer foil layer. This stress ratio supports the load transmission from the outer foil layer to the reinforcement element. In the case of an intense load transmission, the stress in the reinforcement element can optionally also equal far greater than 100% of the stress in the outer foil layer.

The construction of the foil cushion according to the invention with the reinforcement element allows the reinforcement to be realized in a technically new way and simultaneously the material use and the associated production costs of the foil cushion to be reduced significantly.

Below, a preferred embodiment will be explained in greater detail with reference to the accompanying drawing.

DETAILED DESCRIPTION OF EMBODIMENTS OF THE INVENTION

Figure 1:
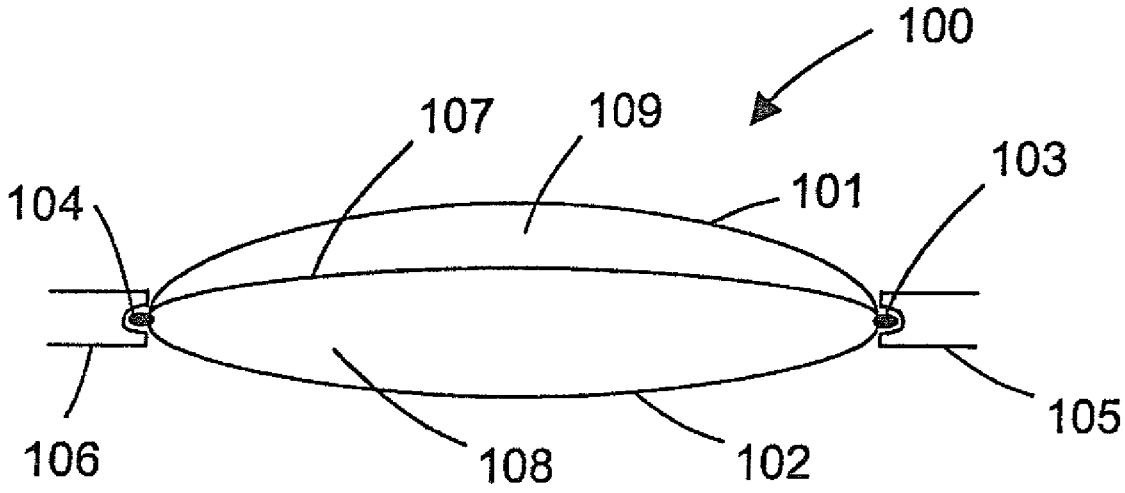
FIG. 1 shows schematically a building encasement element according to the invention in cross section.

In FIG. 1, a building encasement element 100 according to the invention is shown that can form a foil roof or foil facade system with a plurality of additional building encasement elements according to the invention.

The building encasement element 100 according to the invention is made from an outer foil 101, an inner foil 102, and a reinforcement element 107. The reinforcement element has an essentially planar form, i.e., it has a significantly greater extent in length and width than in height. Both the reinforcement element 107 and also the outer film 101 are advantageously made from an elastic material that permits dimensional changes in the reinforcement element 107 or the outer film 101. In this way, it can be advantageous to also form the reinforcement element 107 as a foil.

The outer foil 101, the inner foil 102, and the reinforcement element 107 are welded to each other at their edges 103 and 104, so that a first, essentially fluid-tight, enclosed chamber 108 is produced between the reinforcement element 107 and the inner foil 102 and a second, essentially fluid-tight, enclosed chamber 109 is produced between the reinforcement element 107 and the outer foil 101. The fluid medium in the first chamber 108 is pressurized with a first pressure. The fluid medium in the second chamber 109 is pressurized with a second pressure. In this way, the pressure on the fluid medium in the first chamber 108 is greater than the pressure on the fluid medium in the second chamber 109. The second chamber 109 can also have a smaller volume than the first chamber 108.

For supplying the building encasement element 100 with a fluid medium, in particular, air, a supply device (not shown) can be provided that is advantageously connected via tube or hose lines to the two chambers 108, 109.

Based on the previously described arrangement, the outer foil 101 is curved outward, as can be seen in FIG. 1. In contrast, the inner foil 102 is curved in the opposite direction, that is, in the direction toward the interior of the building. As can be further seen in FIG. 1, the reinforcement element 107 that is advantageously also composed of a foil material is curved in the same direction as the outer foil 101. In contrast to the diagram of FIG. 1, the curvature profiles of the outer foil 101 and the reinforcement element 107 should be as similar to each other as possible.

At its edges 103 and 104, the building encasement element 100 is held by attachment elements 105 and 106 by means of which it is connected to additional building encasement elements and/or a support construction.

If outwards directed forces, for example, wind-drag forces, act on the outer foil 101, then these forces are partially transmitted via the pressurized fluid medium also onto the reinforcement element 107, so that this reinforcement element contributes to the load bearing and prevents failure of the outer foil 101. Because the reinforcement element 107 and the outer foil 101 are made from elastic material, both the reinforcement element 107 and also the outer foil 101 can deform, especially under loading. This dimensional change supports the load transmission from the outer foil 101 onto the reinforcement element 107 via the pressurized fluid medium.

In the reinforcement element 107, the stress here equals at least 80% of the stress in the outer foil 101. From this it can be seen that the reinforcement element has a significant percentage of the load bearing. The stress in the reinforcement element 107, however, can also equal far beyond 100% of the stress in the outer foil 101, especially in the case of loading. This is the case when a large part of the stresses is carried by means of the reinforcement element 107 and thus a failure of the outer foil 101 is prevented.

In addition, the two fluid-filled chambers 108 and 109 can contribute to the thermal insulation effect of the building encasement element 100.

The invention claimed is:

1. Building encasement element with a foil cushion that comprises an outer foil layer forming the outside of a building envelope and an inner foil layer forming the inside of a building envelope, wherein these foil layers form, between themselves, at least one essentially fluid-tight, enclosed hollow space in which a fluid medium is contained, and with a reinforcement element wherein:

the reinforcement element divides the essentially fluid-tight, enclosed hollow space into a first, essentially fluid-tight, enclosed chamber between the inner foil layer and the reinforcement element and into a second, essentially fluid-tight, enclosed chamber between the outer foil layer and the reinforcement element, the fluid medium in the first chamber is pressurized with a first pressure and the fluid medium in the second chamber is pressurized with a second pressure that is below that of the first, and one or both of the magnitudes of the first and second pressures and the ratio of the first and second pressures is formed so that the reinforcement element reduces the stress on the outer foil layer by transmitting a part of the stress of the outer foil layer via the pressurized fluid medium onto the reinforcement element.

2. Building encasement element according to claim 1, wherein at least a portion of the reinforcement element is made from a material that permits dimensional changes.

3. Building encasement element according to claim 1, wherein at least a portion of the outer foil layer is made from a material that permits dimensional changes.

4. Building encasement element according to claim 1, wherein the reinforcement element is formed as an essentially planar element.

5. Building encasement element according to claim 4 in which the outer foil layer is curved outward, wherein the reinforcement element is curved in the same direction as the outer foil layer.

6. Building encasement element according to claim 5, wherein the curvature of the reinforcement element is similar to the curvature of the outer foil layer.

7. Building encasement element according to claim 1, wherein the reinforcement element is formed as an additional foil layer.

8. Building encasement element according to claim 1, wherein the second chamber has a smaller volume than the first chamber.

9. Building encasement element according to claim 1, wherein the stress in the reinforcement element equals at least 80% of the stress in the outer foil layer.

10. Building encasement element according to claim 1, wherein the stress in the reinforcement element equals greater than 100% of the stress in the outer foil layer.

11. Building encasement element according to claim 1, wherein one or both of the magnitudes of the first and second pressures and the ratio of the first and second pressures is formed so that the reinforcement element reduces outward directed drag effects.

12. Building encasement element according to claim 2, wherein the material that permits dimensional changes comprises an elastic material.

13. Building encasement element according to claim 3, wherein the material that permits dimensional changes comprises an elastic material.

* * * * *